US007270072B2

(12) United States Patent
Waldrop

(10) Patent No.: US 7,270,072 B2
(45) Date of Patent: Sep. 18, 2007

(54) FLORIDA ANCHOR

(76) Inventor: Donald L. Waldrop, 530 Palm Dr., Winter Garden, FL (US) 34787

( * ) Notice: Subject to any disclaimer, the term of this patent is extended or adjusted under 35 U.S.C. 154(b) by 23 days.

(21) Appl. No.: 11/349,095

(22) Filed: Feb. 8, 2006

(65) Prior Publication Data

US 2006/0207489 A1 Sep. 21, 2006

Related U.S. Application Data

(60) Provisional application No. 60/594,232, filed on Mar. 21, 2005.

(51) Int. Cl.
*B63B 21/26* (2006.01)
*B63B 21/24* (2006.01)
*E02D 5/74* (2006.01)

(52) U.S. Cl. ..... 114/295; 114/294; 52/155

(58) Field of Classification Search ..... None
See application file for complete search history.

(56) References Cited

U.S. PATENT DOCUMENTS 2,536,908 A * 1/1951 Chadwick ..... 114/230.26
2,907,294 A 10/1959 Lawler
3,238,912 A 3/1966 Perlick
3,626,887 A 12/1971 Schutt
3,638,257 A * 2/1972 Ernst ..... 114/351
3,693,569 A 9/1972 Chauvin
3,774,361 A 11/1973 Tanner
4,604,961 A 8/1986 Ortloff (Continued)

FOREIGN PATENT DOCUMENTS

FR 2802503 A1 6/2001

(Continued)

OTHER PUBLICATIONS http://www.boatersworld.com/webapp/wcs/stores/servlet/ProductDisplay?storeId+10051&catalogId+10051&langId=-1&productId=13236220.

(Continued)

*Primary Examiner*—Lars A. Olson
*Assistant Examiner*—Daniel V. Venne
(74) *Attorney, Agent, or Firm*—Meier, Bonner, et al.; Timothy L. Hughes, Esquire

(57) ABSTRACT

An anchor system designed to quickly anchor and release a boat in shallow water with minimal effort and little to no distraction from other activities such as fishing, which has an anchor sleeve containing a sleeve liner through which an anchor pole with a pointed bottom end passes through, said anchor pole extending below the hull of a boat into the lake or river bottom beneath, and which anchor pole can engage a locking insert when the anchor pole is twisted in either direction, said locking insert located in a notch cut out of the top of the sleeve liner, allowing the anchor pole to be locked in a stowed position, and which has an upper flange which engages a hand grip wrapped around the top of the anchor pole, preventing the top end of the anchor pole from dropping completely through the boat hull, and which has a bottom flange attached to the boat hull bottom through which the anchor pole passes, and which has an attaching nut which attaches the anchor sleeve to the boat deck.

19 Claims, 6 Drawing Sheets

U.S. PATENT DOCUMENTS

| | | | |
|---|---|---|---|
| 4,702,047 | A | 10/1987 | Stokes |
| 4,756,128 | A | 7/1988 | Danieli |
| 4,892,445 | A | 1/1990 | Paige |
| 4,936,194 | A | 6/1990 | Horowitz |
| 4,960,064 | A | 10/1990 | Mestas |
| 5,613,458 | A | 3/1997 | Owen |
| 6,041,730 | A | 3/2000 | Oliverio |
| 6,058,871 | A | 5/2000 | Tanner |
| 6,070,548 | A | 6/2000 | Ducousso |
| 6,092,484 | A | 7/2000 | Babin |
| 6,126,501 | A | 10/2000 | Hooper |
| 6,220,197 | B1 | 4/2001 | Pohlman |
| 6,606,829 | B2 | 8/2003 | Benincasa |
| 2002/0007775 | A1 | 1/2002 | Woyjeck |

FOREIGN PATENT DOCUMENTS

| | | | |
|---|---|---|---|
| WO | WO9910228 | A1 | 3/1999 |

OTHER PUBLICATIONS http://www.cajunanchor.com/.

* cited by examiner

FLORIDA ANCHOR

CROSS REFERENCE TO RELATED APPLICATIONS

This application claims the benefit of provisional application No. 60/594,232's filing date of Mar. 21, 2005.

BACKGROUND OF THE INVENTION

1. Field of the Invention

This invention allows one riding in a boat to quickly anchor and release his or her boat in shallow water with minimal effort and little to no distraction from other activities, such as fishing. The invention can be used with virtually all fishing boats.

2. Background of the Invention and Related Art

Fishing continues to grow in popularity as a competitive sport. This growth has prompted the invention of many fishing aids designed to assist the fisherman. When fishing in shallow waters, fishermen frequently need to maintain the position of their boat with the trolling motor. Wind and currents generally cause the boat to drift away from the desired position, demanding the fisherman's constant attention to boat position. Additionally, in certain types of fishing, such as "flipping and pitching" or "salt water flats fishing," fisherman work their way along the bank, stopping momentarily in a location, then moving their boat a short distance up the bank and stopping again to fish. Presently, fishermen maintain the position of their boat with constant maneuvering of the trolling motor. As a result, fishermen have a need to be able to quickly anchor, release, and re-anchor their boat over and over while fishing without being distracted from their fishing activities. The ability to quickly anchor, release and re-anchor would be helpful to all fishermen, but particularly those involved in competitive fishing. While a number of spear or rod type anchors exist, none provide the ability to quickly anchor, release, lock in the stowed position, unlock and re-anchor with one hand.

The Florida Anchor is a novel anchor used to maintain a boat's position in shallow waters. The Florida Anchor allows the boat operator to anchor and release the boat quickly and efficiently with just one hand. The Florida Anchor uses a simple design which is inexpensive to manufacture and works with virtually any small boat. When not in use, The Florida Anchor can be stored inside the boat so that it is neither in the way of boat occupants nor take away from the boat's appearance.

SUMMARY OF THE INVENTION

It is a general object of the present invention to provide a boat operator the ability to quickly anchor the boat, release the anchor, then re-anchor the boat in an efficient manner without the need for the operator to interrupt other activities, such as fishing.

A further object of the present invention is to provide a fisherman the ability to anchor the boat, release the anchor, then re-anchor the boat with one hand, thus preventing the need to sit down a fishing pole or be otherwise distracted from fishing.

A still further object of the present invention is to provide an anchor which is easily stored within the boat when not in use in a way that does not detract from the boat's overall aesthetic appearance.

According to the present invention, the foregoing and other advantages are achieved by passing a rod or spear through a hollow sleeve running from the boat deck to the boat bottom. The rod tip is embedded in the lake or river bottom. The anchor is released by simply raising the rod and twisting it to lock it into place. The rod remains locked in this stowed position until the boat operator desires to anchor again. Re-anchoring is accomplished through twisting the rod and embedding it again into the lake or river bottom.

BRIEF DESCRIPTION OF THE DRAWINGS

The invention, together with the other objects, features, aspects and advantages thereof, will be more clearly understood from the following in conjunction with the accompanying drawings.

Six sheets of drawings are provided. Sheet one contains FIGS. 1 and 2. Sheet two contains FIG. 3. Sheet three contains FIG. 4. Sheet four contains FIG. 5. Sheet five contains FIG. 6. Sheet six contains FIG. 7.

DETAILED DESCRIPTION OF THE PREFERRED EMBODIMENT

Figure 1:
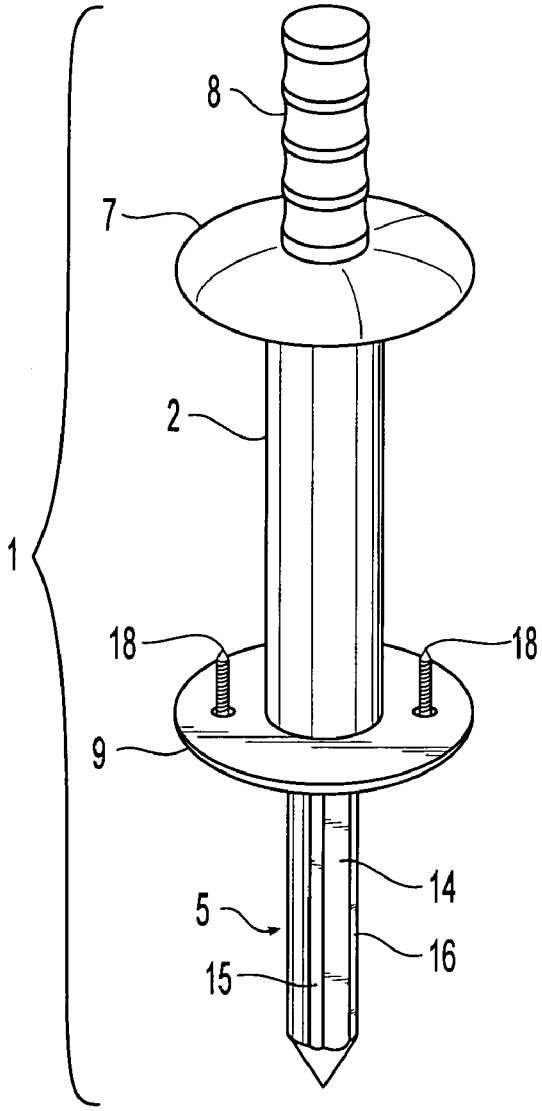
FIG. 1 is a perspective view of the Florida Anchor Assembly.

As shown in FIG. 1, the Florida Anchor Assembly 1 includes an anchor pole 5, which is cylindrical in shape, having a blunt top end, a pointed bottom end, a large flat surface 14 machined along one side of the anchor pole parallel to the anchor pole's longitudinal axis and a hand grip 8 attached to its blunt top end. The hand grip 8 is thick enough to prevent the hand grip 8 from passing through the upper flange 7 and can be made of a rubber material. The anchor pole 5 can be made of a high-density molded fiberglass material, and can have two smaller flat surfaces 15 and 16 machined along its longitudinal axis, chamfered at an angle on either side of the large flat surface 14. The anchor pole 5 passes through the upper flange 7, the anchor sleeve 2, which can be made of a stainless steel material, and the bottom flange 9. Both the upper flange 7 and the bottom flange 9 have a bore extended longitudinally therethrough large enough to allow the anchor pole 5 to pass therethrough.

Figure 2:
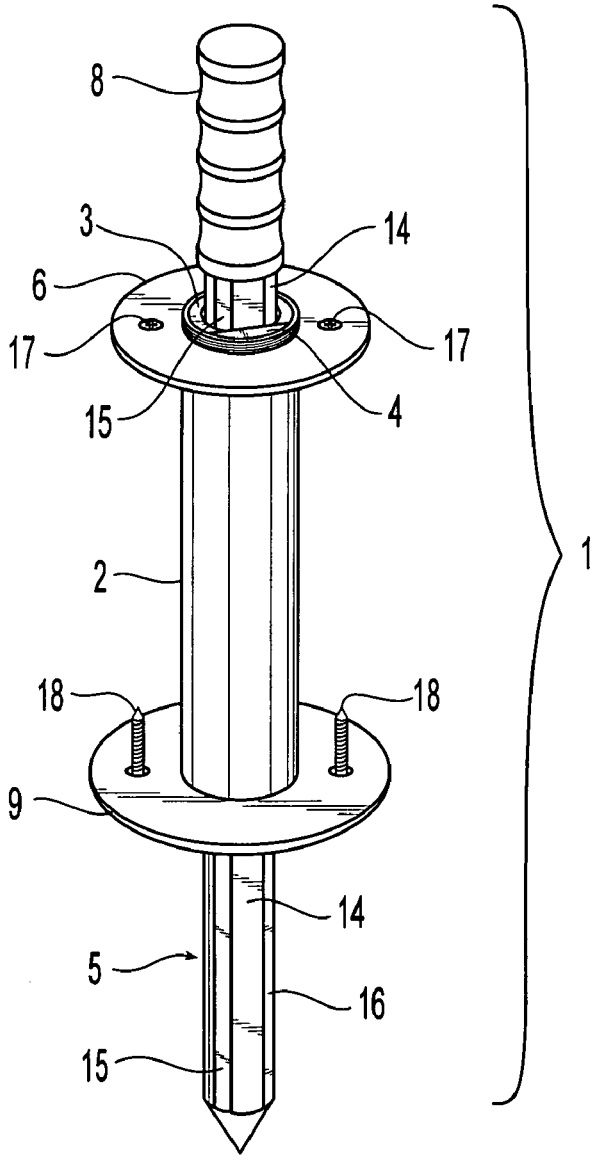
FIG. 2 is a perspective view of the Florida Anchor Assembly 1 without the upper flange 7 in place.
Figure 3:
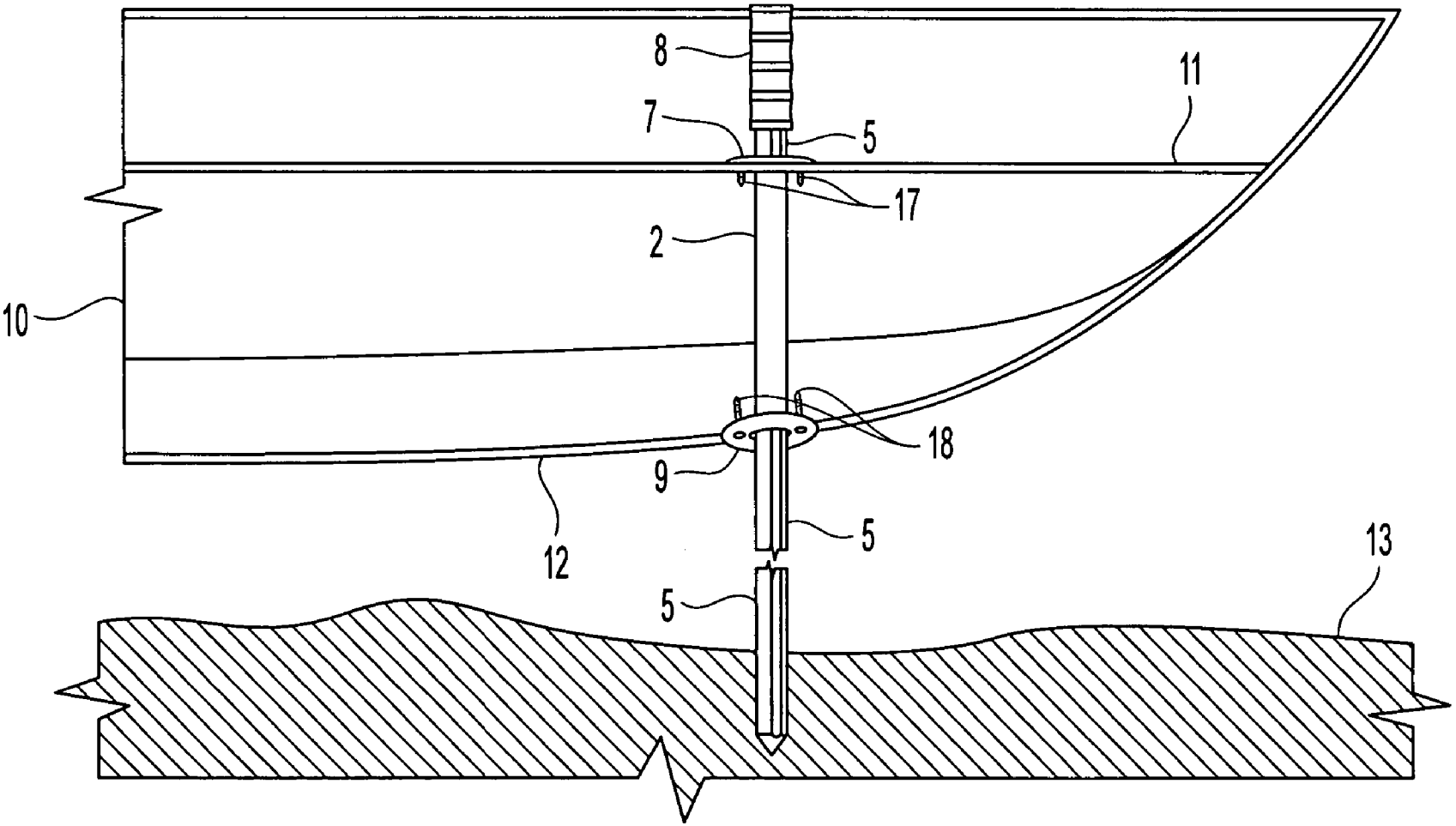
FIG. 3 is a side view of the Florida Anchor Assembly 1 in the anchored position.

FIG. 2 shows the Florida Anchor Assembly 1 with the upper flange 7 removed. FIG. 2 shows the sleeve liner 3, which can be made of a cast nylon material, placed within the anchor sleeve 2. The locking insert 4, which can be made of an ultra high molecular weight polyethylene material, is also placed within the anchor sleeve 2 at the top end of the anchor sleeve 2. The locking insert 4 fills a notch cut in the top end of the sleeve liner 3. The anchor pole 5 is inserted within both the anchor sleeve 2 and the sleeve liner 3 so that the anchor pole's large flat surface 14 is aligned with the locking insert 4. When the anchor pole 5 is not embedded in a lake or river bottom, it may be easily locked in place by twisting the anchor pole 5 using the hand grip 8 so that one of the anchor pole's smaller flat surfaces 15 and 16 comes into contact with the locking insert 4, forcing the rounded portion of the anchor pole 5 against the interior peripheral surface of the sleeve liner 3. When the anchor pole 5 is so forced against the interior peripheral surface of the sleeve liner, the anchor pole 5 is locked in place. The anchor pole 5 is unlocked, or released, by rotating the anchor pole 5 with the hand grip 8 so that the anchor pole's large flat surface is aligned with the locking insert 4. Attaching nut 6 has a bore extended longitudinally therethrough, an interior peripheral surface and an exterior peripheral surface and can be secured to the top end of the anchor sleeve 2 with mating screw threads machined into the top end of anchor sleeve 2 and the interior peripheral surface of the attaching nut 6. Attaching nut 6 can be secured to FIG. 3 is a side view of the Florida Anchor Assembly 1, secured to a boat hull 10, in the anchored position. FIG. 3 shows the anchor sleeve 2, cylindrical in shape, passing through a boat hull 10, said anchor sleeve 2 having a top end, a bottom end, a bore extended longitudinally therethrough, an interior peripheral surface, and an exterior peripheral surface. The anchor pole 5 is shown embedded in a lake or river bottom 13. When the anchor pole 5 is embedded in a lake or river bottom 13, the Florida Anchor Assembly 1 maintains the boat hull 10 in the desired position. The attaching nut can be secured to the boat deck 11 by attaching nut screws 17 penetrating the boat deck 11. The bottom flange can be secured to the boat hull bottom 12 by bottom flange screws 18 penetrating the bottom flange 9 and the boat hull bottom 12.

Figure 4:
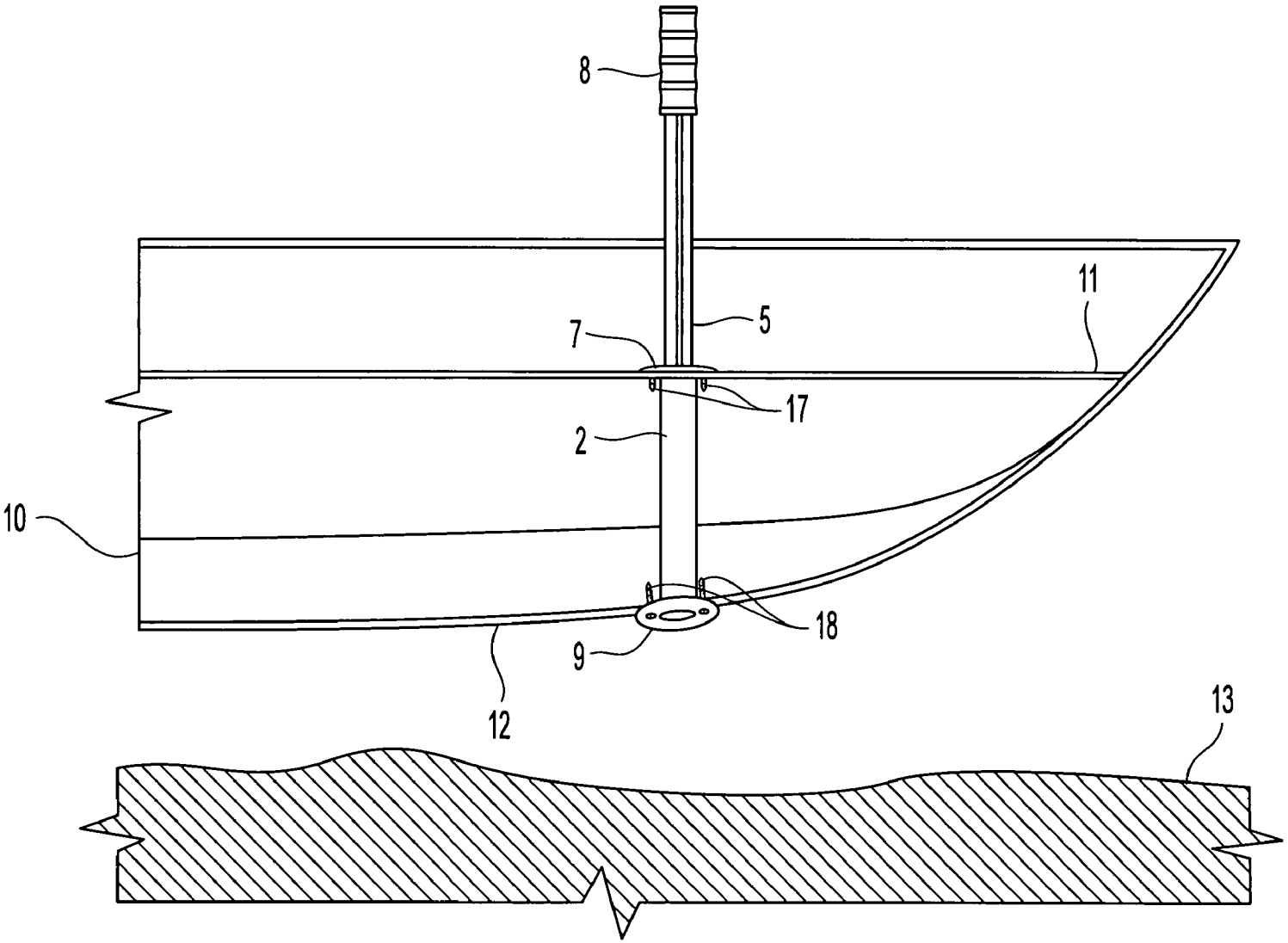
FIG. 4 is a side view of the Florida Anchor Assembly 1 in the stowed position.

FIG. 4 is a side view of the Florida Anchor Assembly 1 in the stowed position. In this position, the pointed end of the anchor pole 5 is withdrawn inside the boat hull 10, allowing the boat hull 10 to move about freely.

Figure 5:
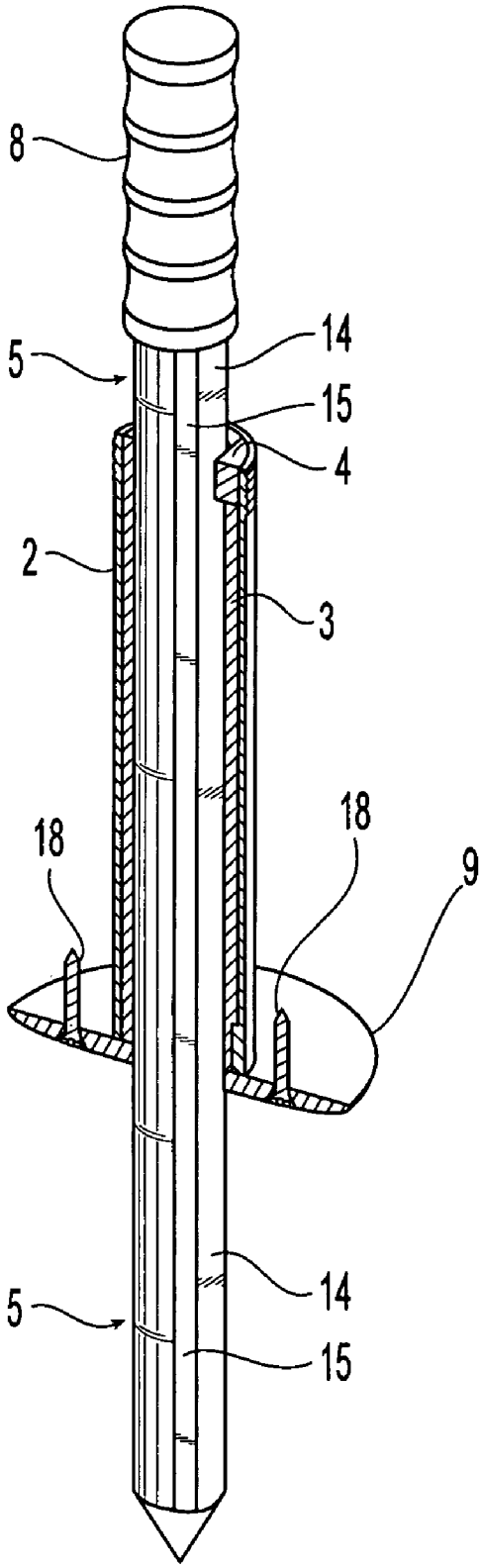
FIG. 5 is a partial cross-sectional view of FIG. 2.

FIG. 5 is a partial cross-sectional view of the Florida Anchor Assembly 1. FIG. 5 shows how locking insert 4 sits within the anchor sleeve 2 at the top end of the anchor sleeve 2. Locking insert 4 fills a notch cut in the top end of the sleeve liner 3 and sleeve liner 3 fits snugly within anchor sleeve 2.

Figure 6:
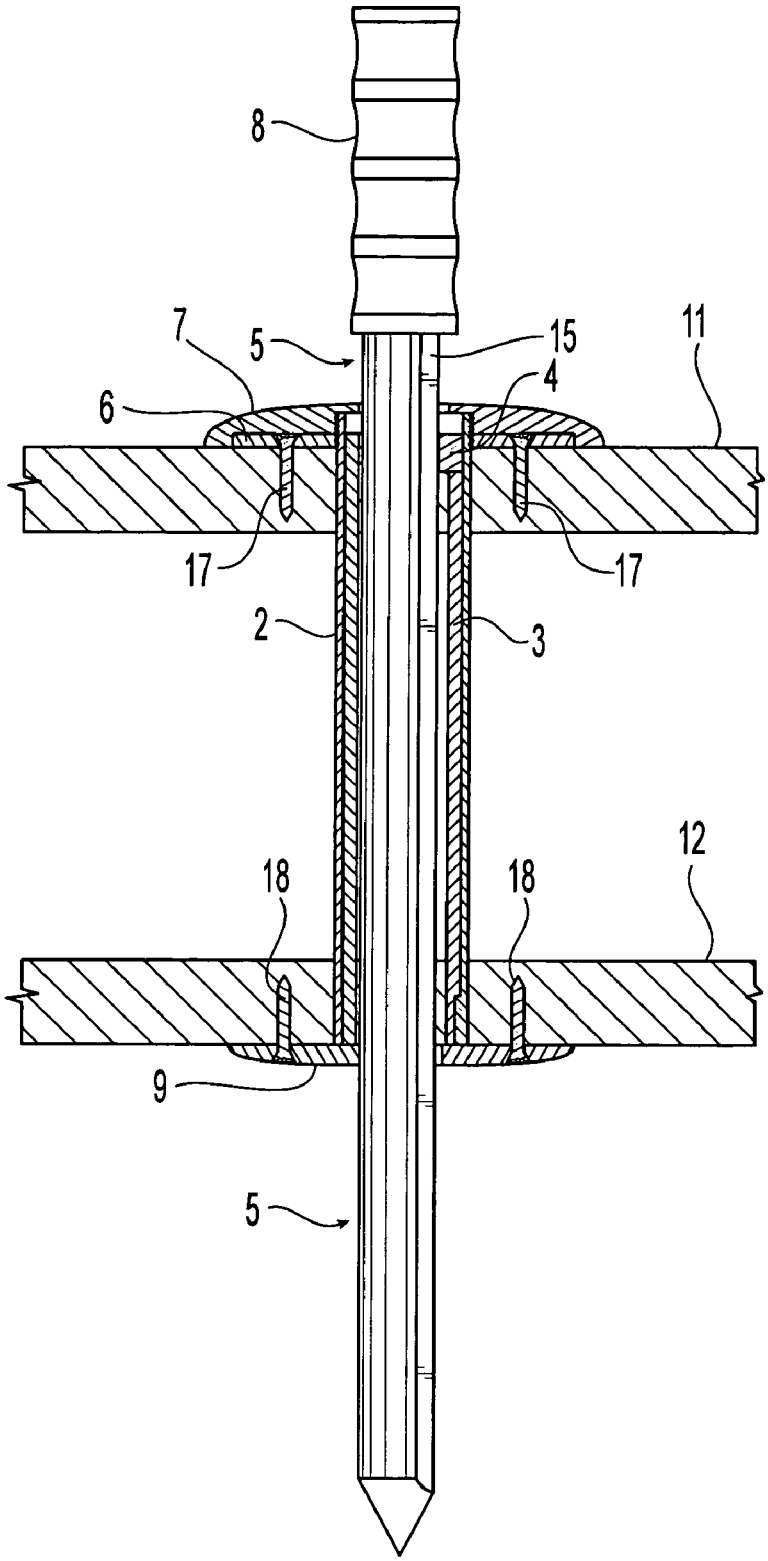
FIG. 6 is a cross-sectional view of FIG. 3.

FIG. 6 is a partial cross-sectional view of the Florida Anchor Assembly 1. The upper flange 7 can have a domed upper surface, a flat bottom surface, a bore drilled from the flat bottom surface of the upper flange 7, extending only part-way into the upper flange 7, leaving an interior circumferential surface within the upper flange 7, and screw threads machined into the upper flange 7's interior circumferential surface, sized to mesh with the screw threads at the top end of the anchor sleeve 2, allowing the upper flange 7 to be thereby secured to said anchor sleeve 2. The upper flange 7 sits directly on top of the attaching nut 6. Attaching nut 6 attaches to the anchor sleeve 2 with mating screw threads machined into the top of anchor sleeve 2 and the attaching nut 6's interior peripheral surface. Attaching nut 6 can attach to a boat deck 11 with attaching nut screws 17. The bottom flange 9 can be attached to a boat hull bottom 12 with bottom flange screws 18.

Figure 7:
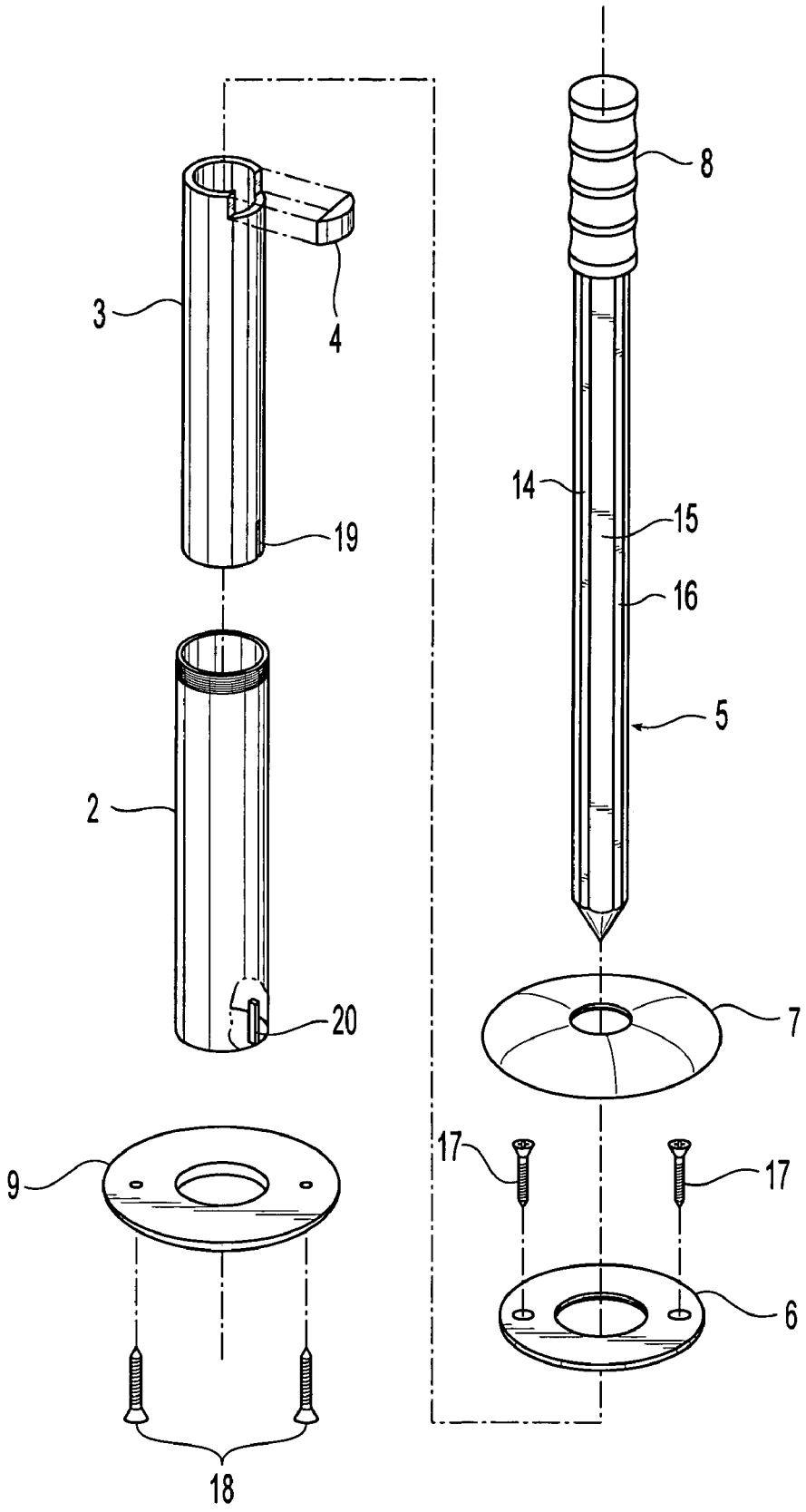
FIG. 7 is an exploded view of FIG. 1.

FIG. 7 is an exploded view of the Florida Anchor Assembly 1. The sleeve liner 3 is cylindrical in shape, having a top end, a bottom end, a bore extended longitudinally therethrough, an interior peripheral surface, an exterior peripheral surface, and a notch machined into one side of the top end of sleeve liner 3 at a 90 degree angle to the sleeve liner 3's longitudinal axis extending completely through one side of the sleeve liner 3's interior peripheral surface. The sleeve liner 3 is of a length equivalent to the length of the anchor sleeve 2 and positioned within the anchor sleeve 2 so that the bottom end of the sleeve liner 3 is aligned with the bottom end of anchor sleeve 2 and the top end of the sleeve liner 3 is aligned with the top end of anchor sleeve 2. The sleeve liner 3 can have a keyway 19 machined into its bottom end. The keyway 19 fits over a locking key 20, which can protrude from the interior peripheral surface of the anchor sleeve 2. The keyway 19 and mating locking key 20 are used to prevent the sleeve liner 3 from rotating inside the anchor sleeve 2. The anchor pole 5 can have two smaller flat surfaces 15 and 16 used to facilitate locking the anchor pole 5 in position when the anchor pole 5 is twisted in either direction.

DRAWING ITEM INDEX

1 Florida Anchor Assembly
2 Anchor Sleeve
3. Sleeve Liner
4. Locking Insert
5. Anchor Pole
6. Attaching Nut
7. Upper Flange
8. Hand Grip
9. Bottom Flange
10. Boat Hull
11. Boat Deck
12. Boat Hull Bottom
13. Lake or River Bottom
14. Anchor Pole's Large Flat Surface
15. Anchor Pole's Smaller Flat Surface
16. Anchor Pole's Smaller Flat Surface
17. Attaching Nut Screws
18. Bottom Flange Screws
19. Keyway
20. Locking Key

I claim:

1. A device for quickly anchoring and releasing a boat in shallow water comprising:

an anchor sleeve, cylindrical in shape, passing through a boat hull, said anchor sleeve having a top end, a bottom end, a bore extended longitudinally therethrough, an interior peripheral surface, and an exterior peripheral surface;

a sleeve liner, cylindrical in shape, having a top end, a bottom end, a bore extended longitudinally therethrough, an interior peripheral surface, an exterior peripheral surface, and a notch machined into one side of the top end of said sleeve liner at a 90 degree angle to said sleeve liner's longitudinal axis extending completely through one side of the top end of the sleeve liner's interior peripheral surface, said sleeve liner positioned within said anchor sleeve;

a locking insert, sized to fill the notch machined into one side of the top end of said sleeve liner when said sleeve liner is positioned within said anchor sleeve;

an anchor pole, having a top end, a pointed bottom end, and a large flat surface machined along one side of the anchor pole, parallel to the anchor pole's longitudinal axis, said anchor pole sized to allow movement up and down through said sleeve liner;

an attaching nut, having a bore extended longitudinally therethrough, an interior peripheral surface, and an exterior peripheral surface, secured to a boat deck and positioned around and attached to the top end of said anchor sleeve;

an upper flange, having a bore extended longitudinally therethrough large enough to allow said anchor pole to pass through the bore of said upper flange, said upper flange positioned over said attaching nut and over said anchor sleeve and secured to the top end of said anchor sleeve;

a hand grip, wrapped around and secured to the top end of said anchor pole, having a thickness large enough so as to prevent said hand grip from passing through the bore of said upper flange; and a bottom flange, having a bore extended longitudinally therethrough large enough to allow said anchor pole to pass therethrough, and secured to a boat hull bottom.

2. The device of claim 1, wherein said anchor sleeve further has a locking key protruding from the interior peripheral surface of said anchor sleeve, near the bottom end of said anchor sleeve and said sleeve liner further has a keyway, machined into the exterior peripheral surface of said sleeve liner without penetrating the interior peripheral surface of said sleeve liner, such that the locking key fits inside the keyway when said sleeve liner is placed within said anchor sleeve.

3. The device of claim 1, wherein said anchor sleeve has screw threads machined into the exterior peripheral surface of the top end of said anchor sleeve, said upper flange is secured to said anchor sleeve by screw threads machined into said upper flange, and said attaching nut is secured to said anchor sleeve by screw threads machined into the interior peripheral surface of said attaching nut.

4. The device of claim 1, wherein said anchor pole has two smaller flat surfaces machined along its longitudinal axis, chamfered at an angle on either side of the large flat surface.

5. The device of claim 1, wherein said locking insert has an outer radial surface, an inner flat surface, a top flat surface and bottom flat surface, and is sized to fit snugly into the notch machined into the top end of said sleeve liner.

6. The device of claim 1, wherein screws pass through said attaching nut, parallel to the longitudinal bore passing through said attaching nut.

7. The device of claim 1, wherein said bottom flange is secured to a boat hull bottom by screws passing through said bottom flange and into a boat hull bottom, parallel to the longitudinal bore passing through said bottom flange.

8. The device of claim 1, wherein said locking insert comprises an ultra high molecular weight polyethylene material.

9. The device of claim 1, wherein said sleeve liner comprises a cast nylon material.

10. The device of claim 1, wherein said anchor pole comprises a high-density molded fiberglass material.

11. The device of claim 1, wherein said hand grip comprises a rubber material.

12. The device of claim 1, wherein said anchor sleeve comprises a stainless steel aluminum material.

13. A device for quickly anchoring and releasing a boat in shallow water comprising:

an anchor sleeve, cylindrical in shape, passing through a boat hull, having a top end, a bottom end, a bore extended longitudinally therethrough, an interior peripheral surface, and an exterior peripheral surface, having screw threads machined into the external peripheral surface of the top end of said anchor sleeve;

a sleeve liner, cylindrical in shape, having a top end, a bottom end, a bore extended longitudinally therethrough, an interior peripheral surface, an exterior peripheral surface, and a notch machined into one side of the top end of said sleeve liner at a 90 degree angle to said sleeve liner's longitudinal axis extending completely through one side of the sleeve liner's interior peripheral surface, with said sleeve liner being of a length equivalent to the length of said anchor sleeve and positioned within said anchor sleeve such that the bottom end of said sleeve liner is aligned with the bottom end of said anchor sleeve and the top end of said sleeve liner is aligned with the top end of said anchor sleeve;

a locking insert, having an outer radial surface, an inner flat surface, a top flat surface and bottom flat surface, sized to fill the notch machined into one side of the top end of said sleeve liner when said sleeve liner is positioned within said anchor sleeve;

an anchor pole, cylindrical in shape, having a blunt top end, a pointed bottom end, a large flat surface machined along one side of the anchor pole, parallel to the anchor pole's longitudinal axis, two smaller flat surfaces machined along its longitudinal axis, chamfered at an angle on either side of the larger flat surface, said anchor pole sized to allow movement up and down through said sleeve liner;

an attaching nut, having a bore extended longitudinally therethrough, an interior peripheral surface with screw threads machined therein, and an exterior peripheral surface, with screws passing through said attaching nut, parallel to the longitudinal bore passing through said attaching nut and positioned such that the screw threads on the interior peripheral surface of said attaching nut mesh with the screw threads at the top end of the anchor sleeve;

an upper flange, having a domed upper surface, a flat bottom surface, a smaller bore extended longitudinally therethrough large enough to allow said anchor pole to pass therethrough, a larger bore drilled from the flat bottom surface of said upper flange, extending only part-way into said upper flange, leaving an interior circumferential surface within said upper flange, further having screw threads machined into the interior circumferential surface, sized such that the interior circumferential surface's screw threads mesh with the screw threads at the top end of said anchor sleeve, allowing said upper flange to be secured thereby to said anchor sleeve;

a bottom flange, having a domed lower surface, a bore extended longitudinally therethrough large enough to allow said anchor pole to pass therethrough, secured to a boat hull bottom by screws passing through said bottom flange and into a boat hull bottom, parallel to the longitudinal bore passing through said bottom flange.

14. The device of claim 13, wherein said anchor sleeve has a locking key protruding from the interior peripheral surface of said anchor sleeve, near the bottom end of said anchor sleeve and said sleeve liner further has a keyway, machined into the exterior peripheral surface of said sleeve liner without penetrating the interior peripheral surface of said sleeve liner, such that the locking key fits inside the keyway when said sleeve liner is placed within said anchor sleeve.

15. The device of claim 13, wherein said locking insert comprises ultra high molecular weight polyethylene material.

16. The device of claim 13, wherein said sleeve liner comprises a cast nylon material.

17. The device of claim 13, wherein said anchor pole comprises a high density molded fiberglass material.

18. The device of claim 13, comprising a handgrip, wrapped around and secured to the top end of said anchor pole, having a thickness large enough so as to prevent said handgrip from passing through the bore of said upper flange; and wherein said hand grip comprises a rubber material.

19. The device of claim 13, wherein said anchor sleeve comprises a stainless steel material.

* * * * *